US007398711B1

(12) United States Patent
Liu

(10) Patent No.: US 7,398,711 B1
(45) Date of Patent: Jul. 15, 2008

(54) MULTI-FUNCTION EXTENSION ROD

(76) Inventor: Qing-Xiang Liu, No. 520-9, Jiati Rd., Taiping City, Taichung County (TW) 411

( * ) Notice: Subject to any disclaimer, the term of this patent is extended or adjusted under 35 U.S.C. 154(b) by 0 days.

(21) Appl. No.: 11/763,445

(22) Filed: Jun. 15, 2007

(51) Int. Cl.
*B25B 23/16* (2006.01)
*B25G 1/06* (2006.01)

(52) U.S. Cl. ..... 81/177.2; 81/177.9; 81/177.85

(58) Field of Classification Search ..... 81/177.2, 81/177.6, 177.8, 177.85, 177.9
See application file for complete search history.

(56) References Cited

U.S. PATENT DOCUMENTS 1,473,436 A * 11/1923 Leopold ..... 81/58.3
4,817,476 A * 4/1989 Karge ..... 81/177.85
5,531,140 A 7/1996 Chow
6,523,441 B2 2/2003 Lee
6,823,762 B2 11/2004 Hu
6,857,341 B1 * 2/2005 Cheng ..... 81/177.8
6,874,392 B1 4/2005 Wu
6,901,827 B1 6/2005 Yen

* cited by examiner

*Primary Examiner*—David B Thomas

(57) ABSTRACT

An extension rod comprises a joint segment integrately formed on the extension rod, and a socket-coupling segment pivotally connected with the joint segment. The socket-coupling segment has a socket tool coupling assembly and a joint black coupling assembly that can jut out or retract from the surface of the socket-coupling segment so as to be combined with or released from an external socket tool and the joint segment, respectively. The socket-coupling segment further has a pressing head for controlling an operating pin that drives the socket tool coupling assembly and the joint block coupling assembly simultaneously.

6 Claims, 7 Drawing Sheets

MULTI-FUNCTION EXTENSION ROD

BACKGROUND OF THE INVENTION

1. Technical Field

The present invention relates to extension rods and, more particularly, to a multi-function extension rod having an associated socket-coupling and angle-adjusting mechanism. The disclosed mechanism primarily comprises a pressing head and an operating pin wherein by pressing down the pressing head, the operating pin can reciprocate correspondingly to facilitate altering the bending angle of the extension rod and receiving a socket tool thereon.

2. Description of Related Art

One major problem of a current hand tool is not always convenient and accommodative to work in all the operating environments, especially to those in confined operational space and requiring specific operational angles. To solve this problem, an extension rod has been provided for being combined with various socket tools, adapters, socket tools and suchlike to address all kinds of working needs.

For aiding assembly and disassembly of the socket tool to the extension rod, a socket-coupling mechanism, as shown in FIG. 1, is typically provided at a conventional extension rod. According to the drawing, the conventional socket-coupling mechanism of an extension rod 900 is composed of a coupling segment 901, a ball hole 911 provided at the coupling segment 901 and extended perpendicular to the axis of the extension rod 900, a spring 912 installed in the ball hole 911 and a ball positioned in the ball hole 911 and propped up by the spring 912. When a socket tool (not shown) is sleeved onto the extension rod 900 at the end of the coupling segment 901, the edge of the socket tool can push and press the ball 913 so that the ball 913 can subsequently press the spring 912 downward and retracts from the surface of the extension rod 900. Later, when a positioning recess of the socket tool (not shown) is aligned to the ball hole 911, the spring can resile and prop the ball 913 up to appear at the surface of the extension rod 900 again. At this time, the ball 913 is coupled with the positioning recess of the socket tool and therefore the socket can be fastened to the coupling segment 901 of the extension rod 900. Oppositely, to disassemble the socket tool from the extension rod 900, the socket tool can be reversely pulled away from the coupling segment 901 of the extension rod 900 so that the edge of the socket tool presses the ball 913 downward to compress the spring 912 and the ball 913 can retract from the surface of the extension rod 900. Consequently, the socket tool can be disassembled from the coupling segment 901 of the extension rod 900.

However, since the spring 912 is positioned directly under the ball 913, once the ball 913 gets pushed, the ball 913 goes down to compress the spring 912 and retracts from the positioning recess of the socket tool it is currently coupled with. As a result, the coupling between the extension rod 900 and the socket tool comes released. Hence, such conventional socket-coupling mechanism tends to cause the socket tool assembled thereon slip off the extension rod 900 during operation and is not an optimal solution of the socket-coupling mechanism.

On the other hand, an angle-adjusting mechanism, also shown in FIG. 1, may further be equipped to an extension rod 900. For instance, the rear end of the coupling segment 901 may be movably connected to a joint segment 902, which is integratedly formed on the extension rod 900. The joint segment 902 has its front end formed as a joint block 921 comprising a plurality of positioning recesses 922 thereon. A ball hole 931 is provided at the end of the coupling segment 901 adjacent to the joint block 921 and receives a spring 932 therein. A ball 933 is positioned in the ball hole 931 and normally propped out by the spring 932. Further, a semi-annular arm 95 protrudes from the end of the coupling segment 901 and is pivotally fastened to the joint block 921 by means of a pivot 94. Thereby, the spring 932 normally props out the ball 933 to abut against one aligned positioning recess 922 on the joint block 921. When the coupling segment 901 is rotated with respect to the joint segment 902, the edge of the positioning recess 922 pushes the ball 933 to press the ball 933 that in turn compresses the spring 932 inward the ball hole 931, so that the coupling segment 901 can pivot on the pivot 94 with respect to the joint block 921. When a desired angle between the coupling segment 901 and the joint segment 902 is reached and the ball 933 is aligned to another said positioning recess 922, the spring 932 can naturally resile and push the ball 933 out to abut against the corresponding positioning recess 922.

The aforementioned conventional angle-adjusting mechanism faces the same problem as the conventional socket-coupling mechanism. That is, once the ball 933 gets pressed, the spring 932 thereunder is compressed and causes the ball 933 leave the currently coupled positioning recess 922. Thus, during the operation of the extension rod 900, a user must always pay attention to the direction and angle where he/she is exerting his/her force; otherwise, the relative replacement between the ball 933 and positioning recess 922 is liable to occur and the set bending angle of the extension rod 900 is consequently changed.

One attempt to solving these and similar problems seeks to provide an ejector pin assembly that make the ball and the spring configured remotely. An extension rod having an ejector pin assembly, as shown in FIG. 2, is described as an example. The reference numeral 960 denotes an extension rod which has a pin hole 961 disposed axially within one end thereof; a pressing head 962 disposed radially within a hole 963 on the wall of the extension rod 960; a ball 964 disposed in a bore 965 on the wall of the extension rod 960; and an ejector pin 966 disposed within said pin hole 961 capable of reciprocating along the pin hole 961 by compressing a spring 967 under the control of the pressing head 962. The ejector pin 966 further comprises a first seat 968 and second seat 969 which are in succession and corresponding to the position of the ball 964, wherein the first seat 968 is deeper than the second seat 969. Thereby, when a user presses down the pressing head 962, the ejector pin 966 can be driven to move by compressing the spring 967 so that the ball 964 can fall into the deeper seat 968 and disappear beyond the surface of the extension rod 960. By this means, since the spring 967 is not arranged under the ball 964 directly, the spring 967 can never be compressed by force acting on the ball 964 and consequently, the undesired replacement of the ball 964 as described above can be remedied. Though the improved socket-coupling mechanism is nearing perfection, the '476 Application and other prior art extension rods do not provide a corresponding amelioration to an angle-adjusting mechanism.

Hence, the inventor of the present invention strained to develop a multi-function extension rod having an associated socket-coupling and angle-adjusting mechanism that implements a more compact and more efficient structure to allow a user to couple a socket tool on the extension rod and adjust the bending angle of the extension rod easily by a single pressing while the stability of the combination between the extension rod and a socket toll and the set bending angle of the extension rod is ensured.

SUMMARY OF THE INVENTION

The present invention has been accomplished under these circumstances in view. It is one objective of the present invention to provide a multi-function extension rod having an associated socket-coupling and angle-adjusting mechanism for remedying the problem of the conventional socket-coupling mechanism that the spring settled right below the ball can easily be compress and render the replacement of the ball, so as to ensure the combination between the extension rod and a socket tool coupled therewith.

It is another objective of the present invention to provide a multi-function extension rod having an associated socket-coupling and angle-adjusting mechanism for remedying the problem of the conventional angle-adjusting mechanism that the spring settled right below the ball can easily be compress and render the retraction of the ball, so as to ensure the stability of the bending angle of the extension rod.

It is another objective of the present invention to provide a multi-function extension rod having an associated socket-coupling and angle-adjusting mechanism wherein the socket-coupling and angle-adjusting mechanism can be operated easily by a single pressing, so as to enhance the operational efficiency of the extension rod.

It is another still object of the present invention to provide a multi-function extension rod having an associated socket-coupling and angle-adjusting mechanism wherein the socket-coupling and angle-adjusting mechanism is compact yet efficient so that the manufacturing cost and assembly time of the extension rod can be efficiently reduced.

To achieve these and other objectives of the present invention, the multi-function extension rod having a socket-coupling and angle-adjusting mechanism comprises the following components:

An extension rod primarily comprising a joint segment integrately formed on the extension rod, a socket-coupling segment pivotally connected with the joint segment, wherein the end of the coupling segment adjacent to the joint segment is defined as a pivoting end while the opposite end of the coupling segment is defined as a coupling end for receiving a socket tool sleeved thereon; a pin hole passing through the coupling segment along the axis thereof; an operating pin, which is sized to be snugly and slidably receive in the pin hole; a socket tool coupling assembly equipped on the operating pin and capable of jutting out or retracting from the surface of the socket-coupling segment; a joint block coupling assembly is equipped on the operating pin and capable of jutting out or retracting from the surface of the pivoting end; a spring, sheathing around the operating pin and abutting against the pin hole; a pressing-head hole extending from the surface of the socket-coupling segment and communicating with the pin hole; and a pressing head settled in the pressing-head hole. Thereby, when the spring is at a released position thereof, the socket tool coupling assembly juts out from the surface of the coupling end while the joint block coupling assembly juts out from the surface of the pivoting end. When the pressing head is pressed, the operating pin moves toward the coupling end and makes the spring be at a compressed position thereof so that the socket tool coupling assembly retracts from the surface of the coupling end while the joint block coupling assembly retracts from the surface of the pivoting end.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Figure 1:
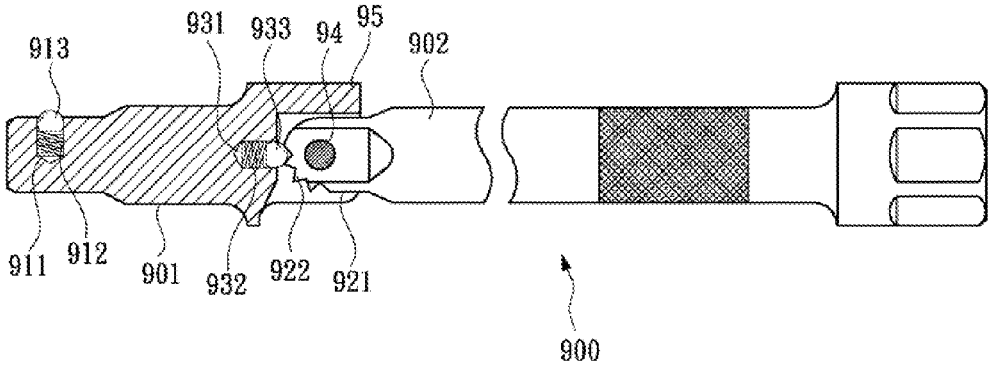
FIG. 1 PRIOR ART
FIG. 1 is a schematic cross sectional view of an extension rod with a conventional socket-coupling mechanism and a conventional angle-adjusting mechanism.
Figure 2:
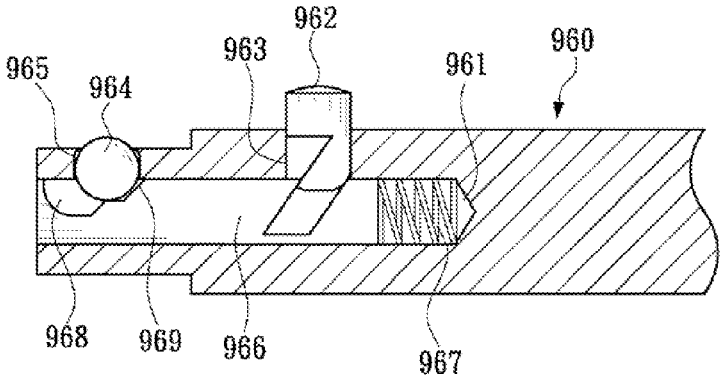
FIG. 2 PRIOR ART
FIG. 2 is a schematic cross sectional view of an extension rod with a conventional extension rod having an ejector pin assembly.
Figure 3:
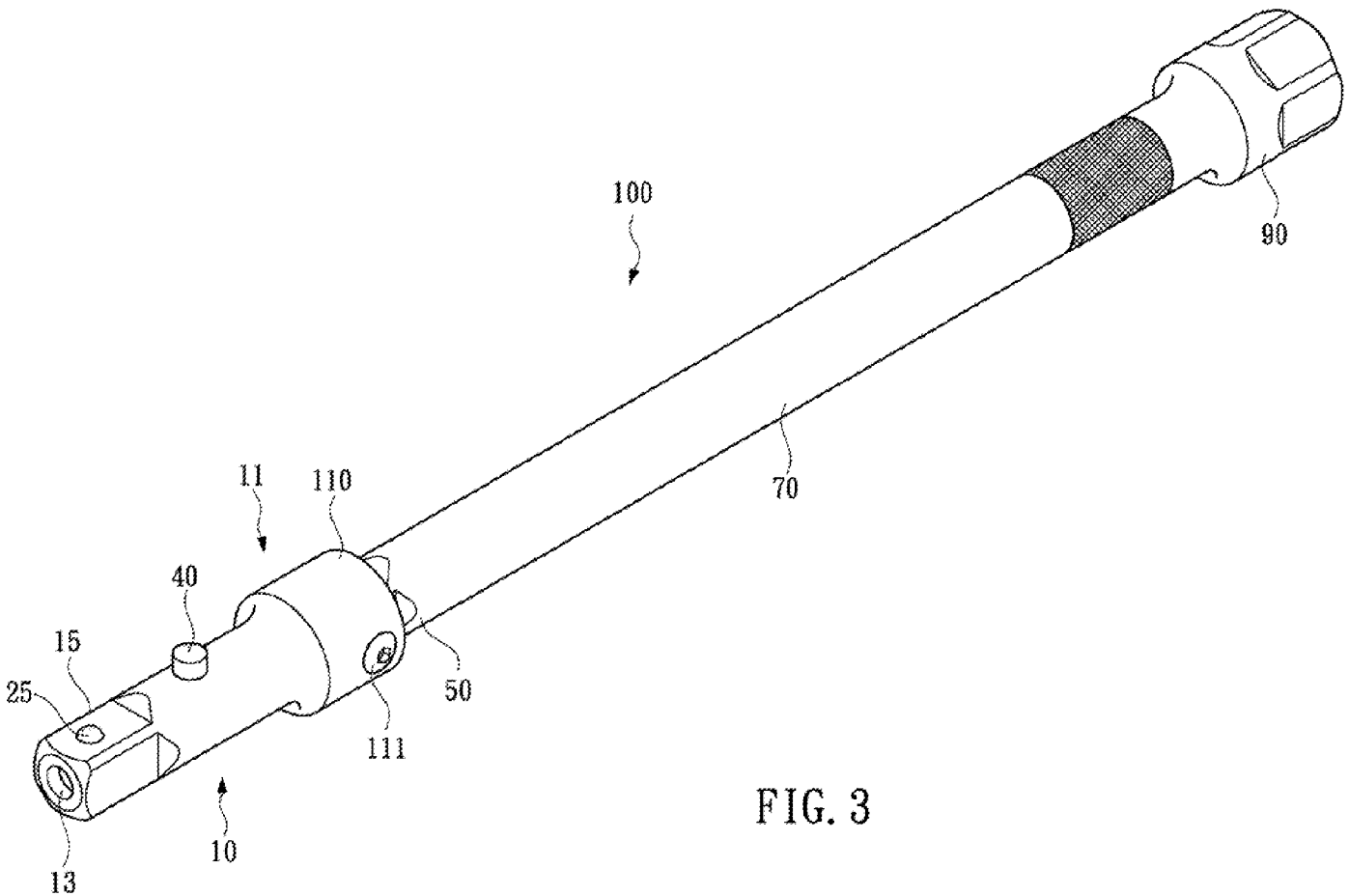
FIG. 3 is a perspective view of a multi-function extension rod having a socket-coupling and angle-adjusting mechanism according to the present invention.
Figure 4:
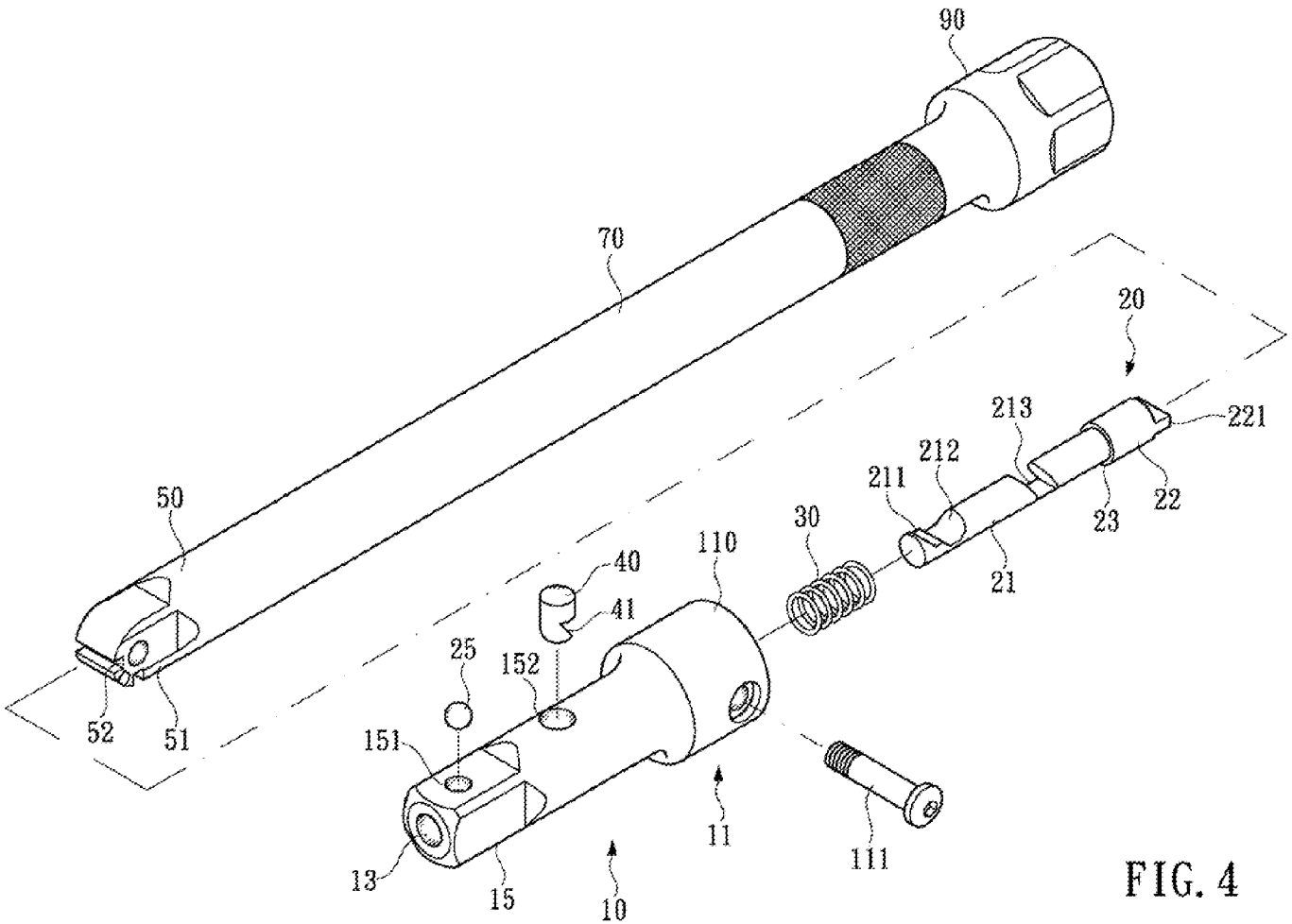
FIG. 4 is an exploded view of the multi-function extension rod having the socket-coupling and angle-adjusting mechanism according to the present invention.
Figure 5:
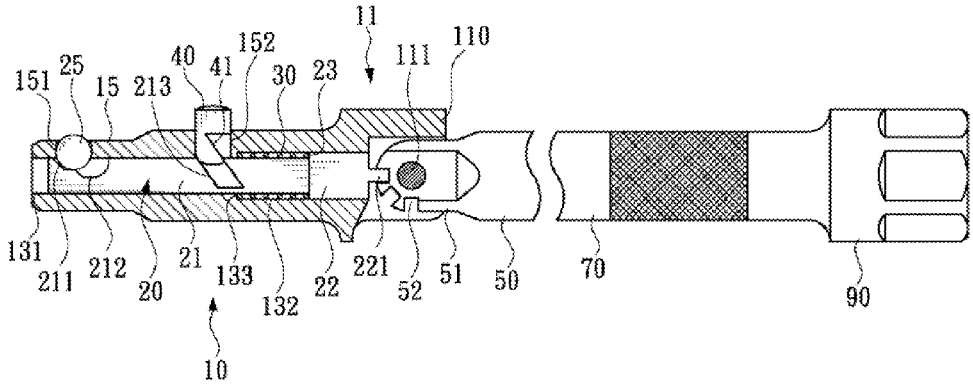
FIG. 5 is a schematic cross sectional view of the multi-function extension rod having the socket-coupling and angle-adjusting mechanism according to the present invention.
Figure 6:
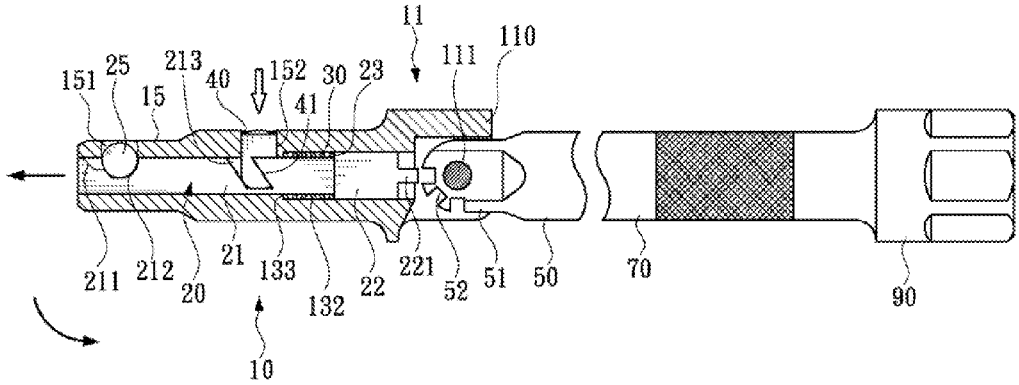
FIG. 6 is an applied view of the multi-function extension rod having the socket-coupling and angle-adjusting mechanism showing the operation thereof.
Figure 7:
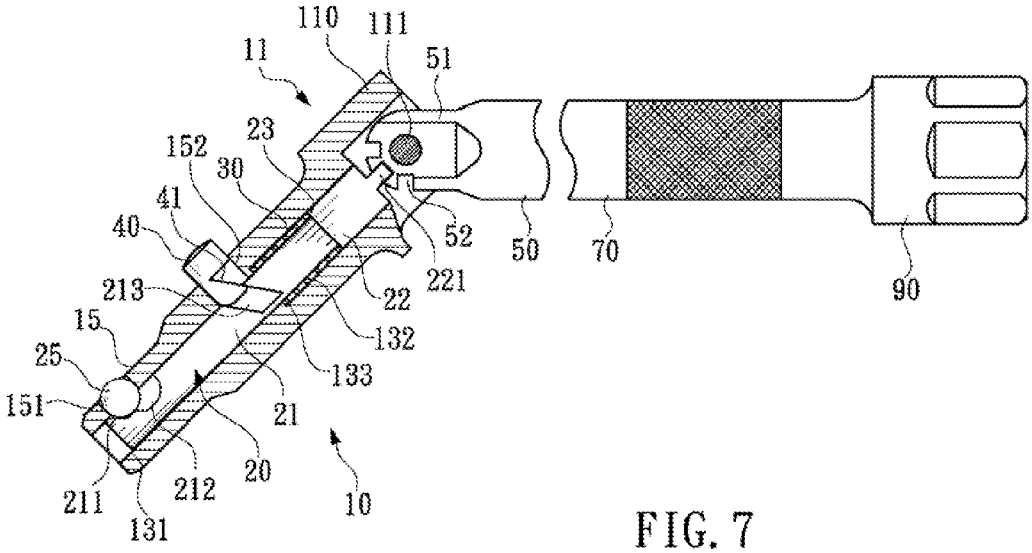
FIG. 7 is an applied view of the multi-function extension rod having the socket-coupling and angle-adjusting mechanism showing the extension rod being bent for an operational angle.
Figure 8:
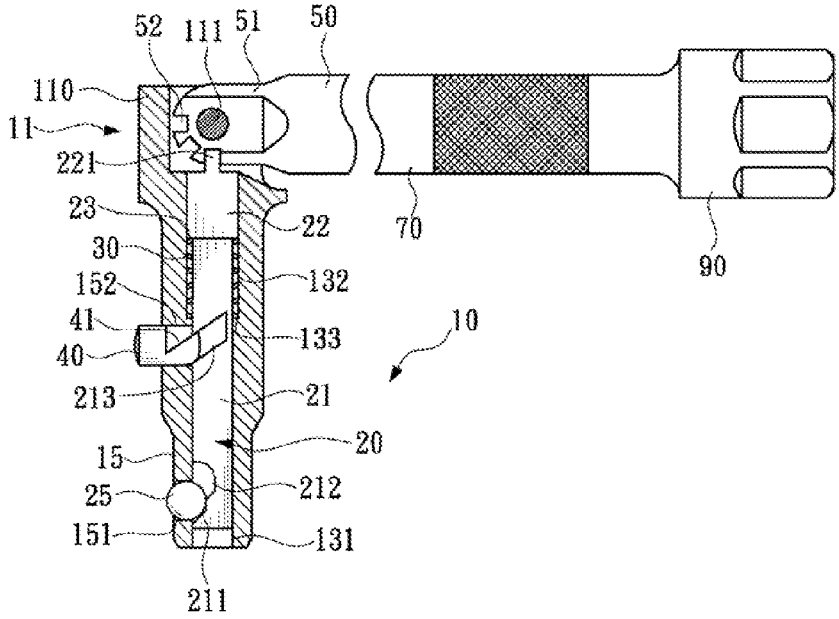
FIG. 8 is another applied view of the multi-function extension rod having the socket-coupling and angle-adjusting mechanism showing the extension rod being bent for another operational angle.
Figure 9:
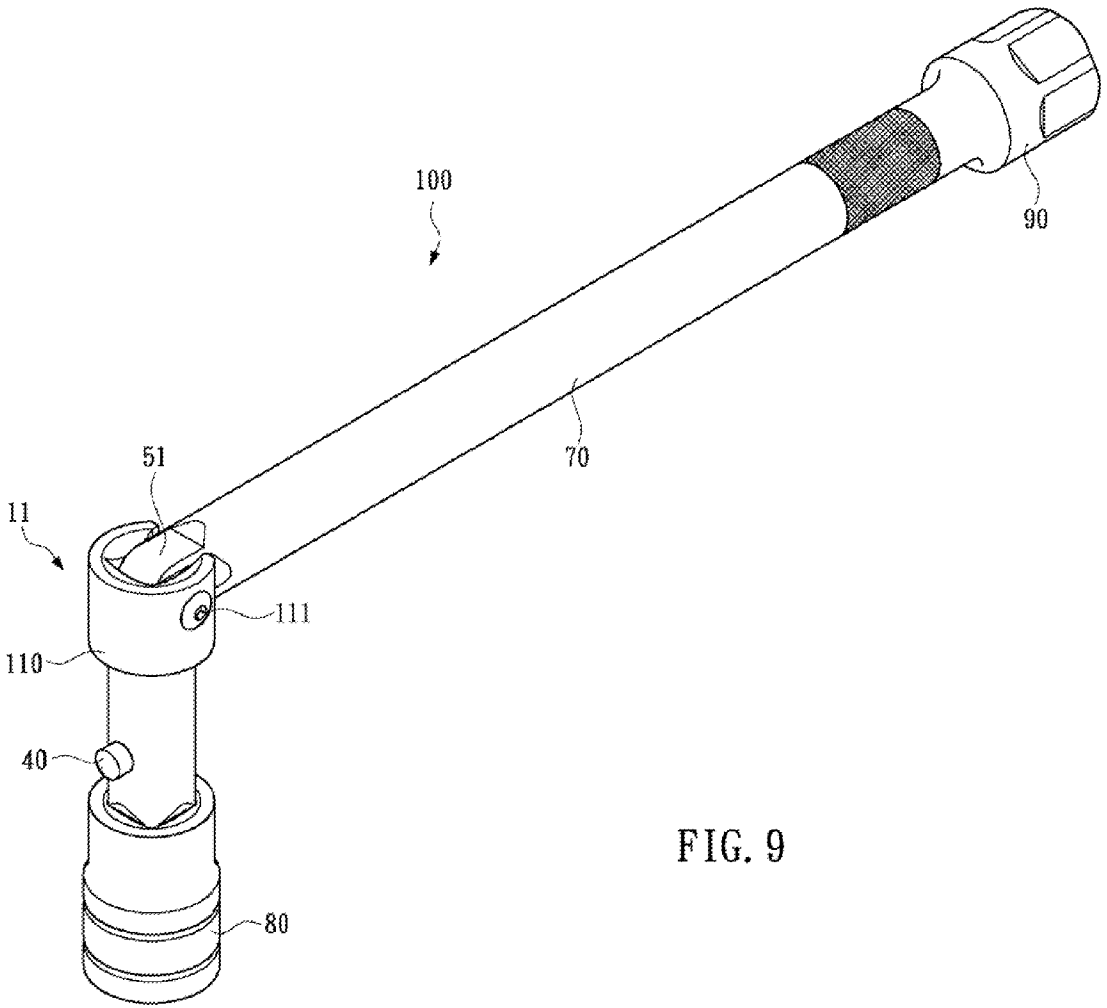
FIG. 9 is an applied view of the multi-function extension rod having the socket-coupling and angle-adjusting mechanism showing the extension rod coupled with a socket tool.

Referring to FIGS. 3 to 5, one embodiment of the multi-function extension rod 100 having the socket-coupling and angle-adjusting mechanism of the present invention is illustrated. The extension rod 100 comprises a coupling segment 10, a joint segment 50 and a gripping segment 70. According to the present embodiment, the extension rod 100 has a socket wrench head 90 connected to the gripping segment 70 and positioned farthest from the coupling segment 10. The socket wrench head 90 is adapted for moveably coupling with an external part so that a user can grip the gripping segment 70 to wrench the external part. The socket-coupling segment 10 is provided for allowing the user to moveably assemble a socket tool thereon. Afterward, the coupling segment 10 can be pivoted with respect to the joint segment 50 such that the extension rod 100 can be bent for and fixed at a desired angle. The end of the coupling segment 10 adjacent to he joint segment 50 is defined as a pivoting end 11 while the opposite end of the coupling segment 10 is defined as a coupling end 15 for receiving a socket tool (as indicated by numeral 80 in FIG. 8) sleeved thereon. The coupling segment 10 includes a pin hole 13 passing therethrough along the axis thereof. The pine hole 13 comprises a first hole section 131 with a first hole diameter near the coupling end 15 and a second hole section 132 with a second hole diameter near the pivoting end 11. As the second hole diameter is greater than the first hole diameter, an annular first retaining surface 133 is formed at the border between the first hole section 131 and the second hole section 132 and facing the second hole section 132.

An operating pin 20 is sized to be snugly and slidably receive in the pin hole 13. The operating pin 20, corresponding to the pin hole 13, has a first pin section 21 with a first pin diameter near the coupling end 15 and a second pin section 22 with a second pin diameter near the pivoting end 11. As the second pin diameter is greater than the first pin diameter, an annular second retaining surface 23 is formed at the border between the first pin section 21 and the second pin section 22 and facing the first pin section 21.

A socket tool coupling assembly is equipped on the first pin section 21 of the operating pin 20 for coupling or releasing a socket tool.

According to one embodiment of the present invention, the socket tool coupling assembly may comprise a ball hole 151 extending from the surface of the coupling end 15 of the socket-coupling segment 10 and communicating with the first diameter hole section 131 of the pin hole 13. A first recess 211 and a second recess 212 abutting mutually are provided on the operating pin 20 corresponding to the ball hole 151 wherein the second recess 212 has a depth greater than that of the first recess 211.

Thereby, when a ball received in the ball hole 151, if the first recess 211 is aligned to the ball hole 151, the ball 25 comes to appear at the surface of the coupling end 15 while if the second recess 212 is aligned to the ball hole 151, the ball 25 retracts from the surface of the coupling end 15 of the socket-coupling segment 10.

The second pin section 22 of the operating pin 20 is provided with a joint block coupling assembly for engaging the joint segment 50 of the extension rod 100. The joint segment 50 has a joint block 51 provided at the end of the joint segment 50 and formed with a plurality of positioning recesses 52. The joint block 51 coupling assembly comprises a semi-annular pivoting arm 110 jutting out from the terminal of the pivoting end 11 of the socket-coupling segment 10 and pivotally combined with the joint block 51 by means of a pivot 111, and a positioning tooth 221 provided at the terminal of the second pin section 132 of the operating pin 20 for being coupled with one of the positioning recesses 52 on the joint block 51.

Referring to FIGS. 4 through 8, according to one concept of the present invention, the positioning tooth 221 may jut out axially from the terminal of the second pin section 22 of the operating pin 20 and formed as a lump with its front surface perpendicular to its upper surface and lower surface, respectively. Correspondingly, each of the positioning recesses 52 on the surface of the joint block 51 is sized to fittingly receive the positioning tooth 221. Hence, when the positioning tooth 221 juts out from the surface of the pivoting end 11 of the socket-coupling segment 10, it is coupled with the currently aligned positioning recess 52 and therefore the replacement between the socket-coupling segment and the joint segment can be restricted. On the contrary, when the positioning tooth 221 retracts from the surface of the pivoting end 11 of the socket-coupling segment 10, it departs from the positioning recess 52, so that the socket-coupling segment 10 can be pivoted on the pivot 11 for an angle with respect to the joint block 51 so as to make the extension rod 100 present a desired bent shape.

Figure 10:
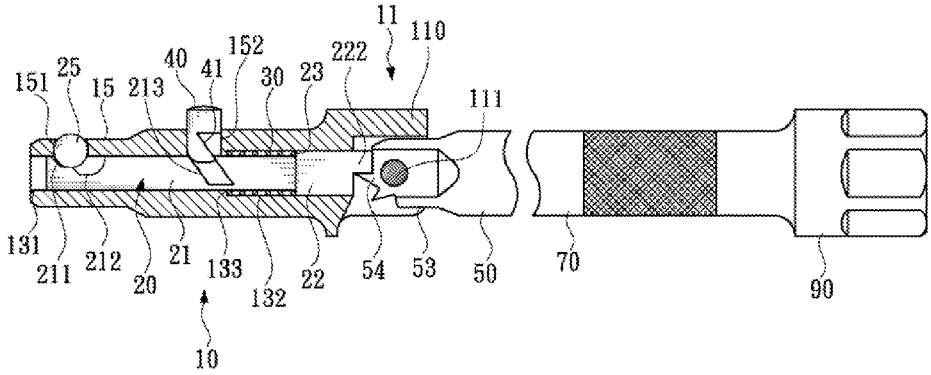
FIG. 10 is a schematic cross sectional view of the multi-function extension rod having the socket-coupling and angle-adjusting mechanism showing an alternative embodiment of the present invention.
Figure 11:
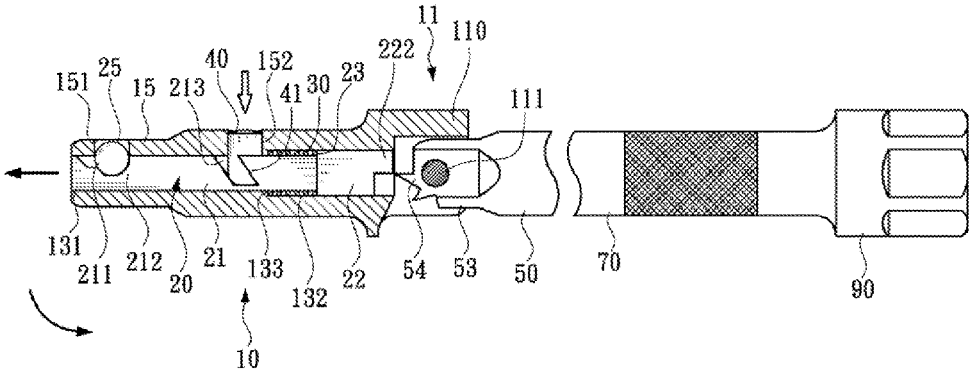
FIG. 11 is an applied view showing the operation of the extension rod in FIG. 9.

According to another concept of the present invention, as showing in FIGS. 10 and 11, the positioning tooth 222 can jut out axially from the terminal of the second pin section 22 of the operating pin 20 and formed as a semicircular lump with its front surface perpendicular to its lower surface. Thus, a pair of positioning surfaces perpendicular mutually is provided. Meanwhile, each of the positioning recesses 54 on the joint block 53 is formed in the manner having a pair of positioning surfaces perpendicular mutually in correspondence to that of the positioning tooth 222. Thereupon, when the positioning tooth 222 juts out from the surface of the pivoting end 11 of the socket-coupling segment 10, the positioning tooth 222 and the currently aligned positioning recess 54 collectively compose a one-way rotatable mechanism, which will be further described below. When the positioning tooth 222 retracts from the surface of the pivoting end 11 of the socket-coupling segment 10, it departs from the aligned positioning recess 54, so that the socket-coupling segment 10 can be pivoted on the pivot 11 for an angle with respect to the joint block 53 so as to make the extension rod 100 present a desired bent shape.

Moreover, the socket-coupling and angle-adjusting mechanism of the present invention further comprises a spring 30 which sheathes around the first section 21 of the operating pin 20 and is positioned between the first retaining surface 133 of the pin hole 13 and the second retaining surface 23 of the operating pin 20. The spring 30 has a released position and a compressed position. When the spring 30 is at the released position thereof, the distance between the first retaining surface 133 of the pin hole 13 and the second retaining surface 23 of the operating pin 20 is relatively longer, while the spring 30 is at the compressed position thereof, the distance between the first retaining surface 133 of the pin hole 13 and the second retaining surface 23 of the operating pin 20 is relatively shorter.

Besides, the socket-coupling and angle-adjusting mechanism of the present invention further comprises a pressing-head hole 152 extending from the surface of the socket-coupling segment 10 and communicating with the first hole section 131 of the pin hole 13. A pressing head 40 is settled in the pressing-head hole 152 with its one end appearing at the surface of the socket-coupling segment 10 and with the other end mechanically connected with the first pin section 131 of the pin hole 13. Specifically, a sloping channel 213 is provided at the first pin section 21 of the operating pin 20 and a sloping surface 41 is provided at the middle portion of the pressing head 40 for snugly mating with the sloping channel 213. Thus, when the pressing head 40 is pressed downward and inward the sloping channel 213, since the pressing head 40 is radially retained in the pressing-head hole 152, the operating pin 20 can be led toward the coupling end 15 under the interaction between the loping surface 41 and the sloping channel 213 and as a result, the second retaining surface 23 of the operating pin 20 is pulled toward the first retaining surface 133 of the pin hole 13.

Hence, when the pressing head 40 is not pressed, the spring 30 is at its released position and separates the first retaining surface 133 and the second retaining surface 23 for the predetermined distance. At this time, the first recess 211 is aligned to the ball hole 151 and props the ball 25 up to jut out from the surface of the coupling end 11. Meanwhile, the position tooth 221 juts out from the pivoting end 11 of the socket-coupling segment 10 and gets coupled with the aligned positioning recess 52.

When the pressing head 40 is pressed, the operating pin 20 moves toward the coupling end 15 within the pin hole 13, so that the second retaining surface 23 is brought to approach the first retaining surface 133 and the distance therebetween is shortened. As a result, the spring 30 is at its compressed position. At this time, the second recess 212 is positioned corresponding to the ball hole 151. Thus, the ball 25 falls in the second recess 212 and leaves from the surface of the socket-coupling segment 10. Meanwhile, the position tooth 221 retracts back to the pivoting end 11 of the socket-coupling segment 10 and departs from the corresponding positioning recess 52 of the joint block 51.

With the operation described above, the user can easily put a socket tool around the coupling end 15 of the socket-coupling segment 10 with the obstruction of the ball 25. Also, the user can freely rotate the socket-coupling segment 10 with respect to the joint block 51 so as to bend the extension rod for a desired operational angle.

Afterward, when the pressing head 40 is released, by the resilience of the spring 30, the second retaining surface 23 is further separated from the first retaining surface 133 again to push the operating pin 20 to move toward the pivoting end 11 within the pin hole 13 until the spring 30 returns its released position. At this time, the ball 25 again appears at the surface of the socket-coupling segment 10 to retain the socket tool put around the coupling end 15 of the socket-coupling segment 10. Meanwhile, the positioning tooth 221 again juts out from the surface of the pivoting end 11 of the socket-coupling segment 10 to be coupled with a corresponding positioning recess 52 so that the socket-coupling segment 10 can be fixedly positioned with respect to the joint segment 50.

What is herein further explained is the difference between the operational advantages of the two preferred embodiments of the joint block coupling assembly according to the present invention. As shown in FIGS. 4 and 5, the positioning tooth 221 has its front, upper and lower surfaces formed as flat surfaces that can be snugly received by the positioning recess 52. Thus, during the operation of the extension rod 100, the positioning recess 52 can hold the positioning tooth 221 despite the wrench direction of the extension rod 100. When the user wants to adjust the bending angle of the extension rod again, he/she can easily press the pressing head 40 and the joint block coupling assembly can be reset.

For additional convenience of the present invention, the alternative embodiment of the joint block coupling assembly is provided by the inventor and shown in FIGS. 10 and 11. According to the drawings, the positioning tooth 222 has a semicircular shape with its front surface perpendicular to its lower surface. Thus, when the positioning tooth 222 is coupled with the aligned positioning recess 54 also having the pair of positioning surfaces perpendicular mutually in correspondence to the positioning tooth 222, the said components collectively compose the one-way rotatable mechanism. That is to say, when the extension rod 100 presents a bent shape, if the user pull the joint segment 50 downward to the socket-coupling segment 10, the lower surface of the positioning recess 54 and the positioning tooth 222 push each other, and the user's pulling force is therefore nullified so that the bending angle of the extension rod 100 can remain without change. On the contrary, if the user pull the joint segment 50 upward to the socket-coupling segment 10, since the positioning recesses 54 provides no restriction to the upper surface of the recesses 54, the pulling force drives the positioning recesses 54 to push the front end of the positioning tooth 222. Consequently, the operating pin 20 is pushed to move toward the coupling end 15 of the socket-coupling segment 10 and in turn compress the spring 30. When the extension rod 100 is adjusted to another desired bent shape, the user has just to stop the upward pulling force, and the positioning tooth 222 can be pushed out by the resilient spring 30 and get coupled with another recess 54 that positioned correspondingly at present. Thereupon, the reset bending angle can be fixed.

Besides, according to another concept of the present invention, the pivoting arm 110 may also be formed as two separated and parallel arms (not shown). Thus, the rotatable angle of the joint block 51, 53 with respect to the socket-coupling segment 10 can come up to 180 degrees so that the further enhanced adaptability of the extension rod can be achieved.

Although the particular embodiments of the invention has been described in detail for purposes of illustration, it will be understood by one of ordinary skill in the art that numerous variations will be possible to the disclosed embodiments without going outside the scope of the invention as disclosed in the claims.

What is claimed is:

1. A multi-function extension rod having an associated socket-coupling and angle-adjusting mechanism, primarily comprising:

the extension rod, comprising a joint segment integrately formed on the extension rod, a socket-coupling segment pivotally connected with the joint segment; wherein the end of the coupling segment adjacent to the joint segment is defined as a pivoting end while the opposite end of the coupling segment is defined as a coupling end for receiving a socket tool sleeved thereon a pin hole passing through the coupling segment along the axis thereof and comprising a first hole section with a first hole diameter near the coupling end and a second hole section with a second hole diameter near the pivoting end, wherein the second hole diameter is greater than the first hole diameter so that an annular first retaining surface is formed at the border between the first section and the second section and facing the second section;

an operating pin, which is sized to be snugly and slidably receive in the pin hole and having a first pin section with a first pin diameter near the coupling end and a second pin section with a second pin diameter near the joint segment, wherein the second pin diameter is greater than the first pin diameter, so that an annular second retaining surface is formed at the border between the first section and the second section and facing the first section;

a socket tool coupling assembly, equipped on the first section of the operating pin capable of jutting out from or retracting from the surface of the coupling end of the socket-coupling segment for coupling or releasing a socket tool and;

a joint block coupling assembly, equipped on the second section of the operating pin capable of jutting out from or retracting from the surface of the joint segment for coupling or releasing the joint segment of the extension rod and;

a spring, sheathing around the first pin section and positioned between the first retaining surface of the pin hole and the second retaining surface of the operating pin within the pin hole;

a pressing-head hole extending from the surface of the socket-coupling segment and communicating with the first section of the pin hole; and a pressing head settled in the pressing-head hole with its one end appearing at the surface of the socket-coupling segment and with the other end mechanically connected with the first section of the pin hole;

whereby, when the pressing head is not pressed and the spring is at a released position thereof, the distance between the first retaining surface of the pin hole and the second retaining surface of the operating pin is relatively longer and the socket tool coupling assembly juts out from the surface of the coupling end while the joint block coupling assembly juts out from the surface of the pivoting end, and when the pressing head is pressed, the operating pin moves toward the coupling end and the second retaining surface approaches the first retaining surface so as to make the spring be at a compressed position thereof so that the socket tool coupling assembly retracts from the surface of the coupling end while the joint block coupling assembly retracts from the surface of the pivoting end.

2. The multi-function extension rod of claim 1, wherein a sloping channel is provided at the first pin section of the operating pin and a sloping surface is provided at the middle portion of the pressing head for snugly mating with the sloping channel so that when the pressing head is pressed downward and inward the sloping channel, since the pressing head is radially retained in the pressing-head hole, the operating pin can be led toward the coupling end under the interaction between the loping surface and the sloping channel.

3. The multi-function extension rod of claim 1, wherein the socket tool coupling assembly comprising:

a ball hole redially extending from the surface of the socket-coupling segment and communicating with the first diameter hole section of the pin hole;

a first recess provided on the first pin section of the operating pin and positioned corresponding to the ball hole when the spring is at its released position;

a second recess provided on the first pin section of the operating pin and positioned corresponding to the ball hole when the spring is at its compressed position; wherein the second recess has a depth greater than that of the first recess and abuts the first recess; and a ball received in the ball hole, coming to appear at the surface of the socket-coupling segment when the first recess is positioned corresponding to the ball hole and retracting from the surface of the socket-coupling segment when the second recess is positioned corresponding to the ball hole.

4. The multi-function extension rod of claim 1, wherein a joint block is provided at the end of the joint segment and formed with a plurality of positioning recesses and the joint block coupling assembly comprising:

a pivoting arm jutting out from the terminal of the pivoting end of the socket-coupling segment and pivotally combined with the joint block by means of a pivot, and a positioning tooth provided at the terminal of the second pin section of the operating pin for being coupled with one of said positioning recesses of the joint block;

whereby when the spring is at its released position, the positioning tooth is coupled with the aligned recess while when the spring is at the compressed position, the operating pin moves toward the coupling end within the pin hole so that the positioning tooth departs from the currently engaged positioning recess and the socket-coupling segment can be pivoted on the pivot for an angle with respect to the joint block.

5. The multi-function extension rod of claim 4, wherein the positioning tooth juts out axially from the terminal of the second section of the operating pin and formed as a lump with at least two flat surfaces while each of the positioning recesses is formed for snugly receiving the positioning tooth.

6. The multi-function extension rod of claim 1 further comprising a gripping segment.

* * * * *